United States Patent [19]

Bottoms

[11] Patent Number: 4,727,944

[45] Date of Patent: Mar. 1, 1988

[54] PERCUSSION DRILL STRING ASSEMBLY

[76] Inventor: Clifford C. Bottoms, Rte. 2, Box 384L, McKinney, Tex. 75069

[21] Appl. No.: 935,178

[22] Filed: Nov. 26, 1986

[51] Int. Cl.[4] ..... E21B 10/36

[52] U.S. Cl. ..... 175/293; 175/299

[58] Field of Search ..... 166/377, 380; 175/293, 175/299, 306; 173/128, 139

[56] References Cited

U.S. PATENT DOCUMENTS

| | | | |
|---|---|---|---|
| 2,815,930 | 12/1957 | Storm | 175/299 |
| 2,996,131 | 8/1961 | Greenwood | 175/293 |
| 3,599,735 | 8/1971 | Slator et al. | 175/293 |
| 4,635,728 | 1/1987 | Harrington | 166/345 |

*Primary Examiner*—Stephen J. Novosad

*Assistant Examiner*—William P. Neuder

*Attorney, Agent, or Firm*—Freilich, Hornbaker, Rosen & Fernandez

[57] ABSTRACT

A percussion drill apparatus is provided which isolates the surfaces that pound on one another from borehole cuttings, while also sealing in grease, all in a compact assembly. The percussion sub which holds the drill bit and which has an anvil surface which can be repeatedly struck, includes a cylindrical outer surface extending down from the anvil surface. The outer barrel, which has a hammer surface that hammers the anvil surface, carries a cage which surrounds the cylindrical surface, and which holds a seal assembly which seals to the cylindrical surface. Thus, percussion occurs in a sealed area.

7 Claims, 4 Drawing Figures

FIG. 1
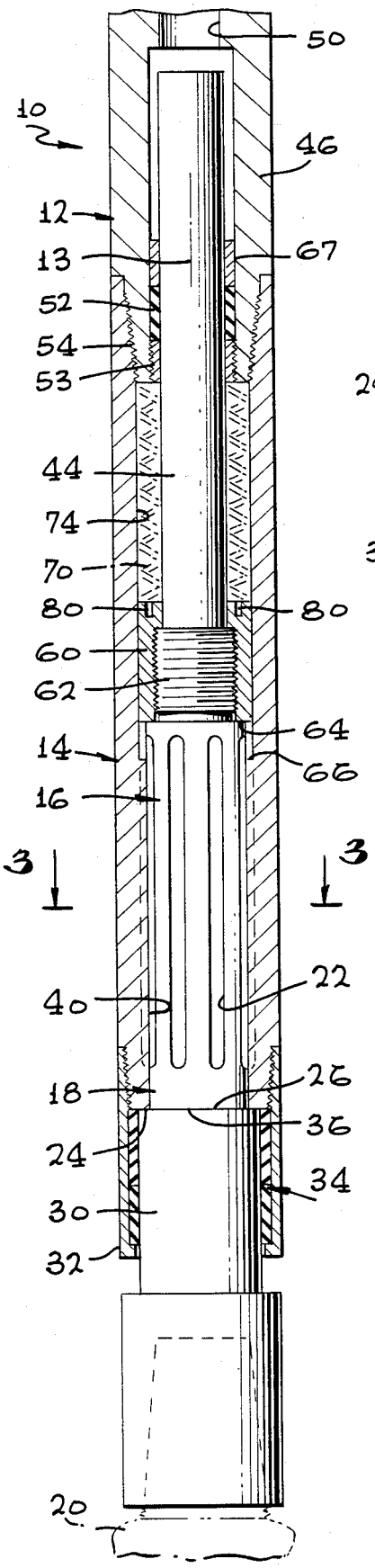
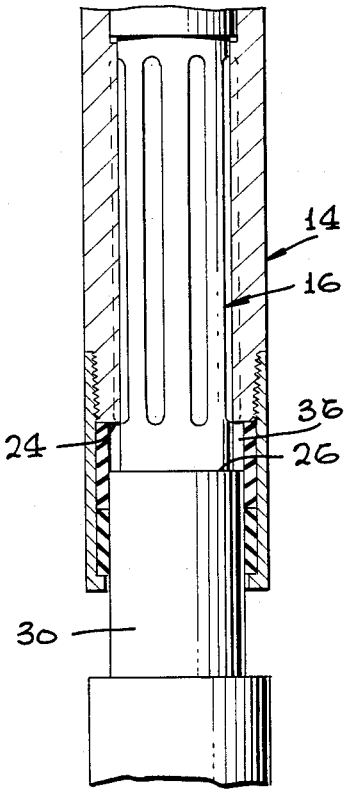
FIG. 2
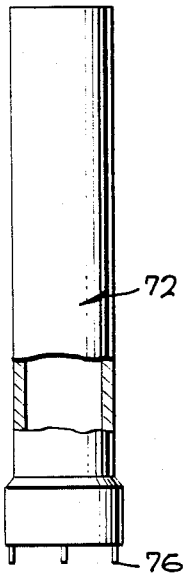
FIG. 4
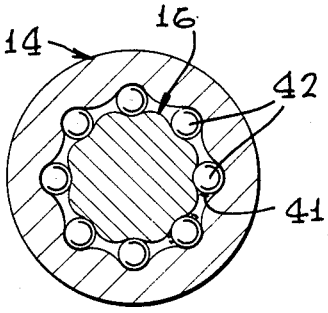
FIG. 3

PERCUSSION DRILL STRING ASSEMBLY

BACKGROUND OF THE INVENTION

In a percussion drill string, the cutting bit may be attached to a percussion sub at the bottom of the drill string, while most of the rest of the drill string can be repeatedly raised and dropped to hit the percussion sub to aid in drilling. If the top of the percussion sub is repeatedly hit, then some of the force is dissipated during its travel through the percussion sub to the cutting bit. Also, damage can occur to portions of the percussion sub. If the hammering occurs at the lower portion of the percussion sub, then there is a possibility that cuttings from the earth will find their way between the hammering surfaces and damage them. A percussion sub which effectively transmitted hammering forces to the cutting bit while avoiding damage to the hammering surfaces, would be of considerable value.

SUMMARY OF THE INVENTION

In accordance with one embodiment of the present invention, a percussion drill apparatus is provided which efficiently transmits percussion to the cutting bit while sealing the hammering surfaces against the intrusion of foreign particles therebetween. The apparatus includes a percussion sub which holds a cutting bit at its lower end and an outer barrel at the lower end of the drill string which can slide with respect to the percussion sub and which has a hammer surface which can hit an anvil surface on the percussion sub. The percussion sub forms a cylindrical surface extending down from the anvil surface, and the outer barrel has a cage extending around the cylindrical surface of the percussion sub and holding a seal that seals to the cylindrical surface. The lower portion of the percussion sub is hit while the seals prevent the entrance of cuttings between the hammer and anvil surfaces.

The outer barrel is threadably attached to the rest of the drill string at a location at least one foot above the top of the percussion sub, so access to the top of the percussion sub can be difficult. Also, a wash pipe extends up from the top of the percussion sub to the upper sub to carry fluid therebetween. An annular hanger nut is threadably connected to the top of the percussion sub, to limit downward movement of the percussion sub so it cannot be lost, and yet to permit disassembly. A downhole tool for tightening and loosening the hanger nut, is of annular cross section to fit in the annular space between the wash pipe and outer barrel.

The novel features of the invention are set forth with particularity in the appended claims. The invention will be best understood from the following description when read in conjunction with the accompanying drawings.

BRIEF DESCRIPTION OF THE DRAWINGS

FIG. 1 is is a partial sectional view of the lower portion of a drill string constructed in accordance with the present invention, showing the hammer and anvil surfaces engaged.

FIG. 2 is a view of a portion of FIG. 1, but with the hammer and anvil surfaces spaced.

FIG. 3 is a view taken on the line 3—3 of FIG. 1.

FIG. 4 is a side elevation view of a downhold tool useful in the apparatus of FIG. 1.

DESCRIPTION OF THE PREFERRED EMBODIMENTS

FIG. 1 illustrates a percussion drill apparatus 10 which includes a drill string 12 that extends along an axis 13 and that has an outer barrel 14 near its lower end. An inner barrel 16 lies primarily within the outer barrel and includes a percussion sub 18. The inner barrel holds a cutting or drill bit 20 at its lower end for drilling a borehole. Drilling is accomplished by rotating the inner barrel 16 and also by hammering it. Rotation is accomplished by rotating the drill string 12 and its outer barrel 14, which is rotatably coupled through splines 22 to the inner barrel 16 to rotate it. Hammering is accomplished by lifting and dropping the drill string, so that a hammer surface 24 at the bottom of the outer barrel strikes an anvil surface 26 on the inner barrel 16.

During drilling, cuttings such as pieces of dirt and rock cut by the bit are present around the bottom of the drill string. To prevent such cuttings from finding their way between the hammer and anvil surfaces 24, 26 and damaging them, applicant provides a cylindrical portion or sub 30 at the lower portion of the inner barrel, and a cage 32 attached to the lower end of the outer barrel to surround the cylindrical sub. A seal assembly 34 lies between the cage and cylindrical sub to seal them during relative sliding movement. The seal assembly prevents the entrance of cuttings into the space 36 between the hammer and anvil surfaces, to prevent damage to these surfaces.

The seal assembly 34 also serves to seal in lubricant which lies between the inner and outer splines 22, 40 that couple the percussion sub 18 of the inner barrel to the outer barrel. It may be noted that the space between the splines 22, 40 hold balls 42 that permit relative axial movement with minimal friction. Such minimal friction is enhanced by maintaining lubricant 41 around the balls which is held in by the seal assembly. The percussion surfaces 24, 26 are located respectively near the bottom of the outer barrel, and in the lower portion of the inner barrel. Locating the anvil surface 26 near the bottom of the inner barrel has the advantage that less of the inner barrel 16 is subject to large shocks, and therefore does not have to be made as sturdy or be subject to fatigue failure because of such shocks. Also, striking the lower portion of the inner barrel results in better transmission of shocks to the cutting bit 20. Since the striking surfaces 24, 26 lie below the splines 22, 40, striking occurs at a surface 26 on the inner barrel of large diameter by an outer portion of the outer barrel, for large area contact to transmit and absorb shock.

The inner barrel includes a wash pipe 44 extending upwardly from the percussion sub 18 and integral with it, the wash pipe extending into an upper sub 46 of the drill string that lies above the outer barrel 14 and which is threadably connected at 54 thereto. The wash pipe 44 serves to carry drilling mud between a conduit 50 in the upper portion of the drill string and through the inner barrel to the location of the cutting bit 20. The wash pipe 44 passes through the outer barrel 14 and is sealed by a packing or seal 52 to the inside of the upper sub, which is held by a packing nut 53. Such sealing avoids the leakage of fluid through the threads 54 by which the outer barrel 14 is coupled to the upper sub 46. The outer barrel is subjected to pounding and must occasionally be disconnected from the upper sub to gain access to the inner barrel where considerable maintenance is required, and it is useful to not rely upon the thread 54 as a fluid seal.

The inner barrel is prevented from dropping out of the outer barrel when the drill string is lowered or raised out of the borehole, by a hanger nut 60 that is threadably coupled to a threaded upper portion 62 of the percussion sub 18 of the inner barrel. If the inner barrel starts to drop, the lower surface 64 of the hanger nut will contact an upwardly facing shoulder 66 on the outer barrel.

Access is required to the packing nut 53 to maintain the packing 52 and a guide ring 67. Access is also required to the hanger nut 60 to enable removal of the inner barrel for maintenance. Instead of requiring the outer barrel 14 to be divided into two threaded sections to enable such access, with an additional thread below the hanger nut 60, applicant makes the outer barrel longer so that the threads 54 lie more than one foot above the top of the hanger nut 60 near the packing nut 53. When the lower portion of the apparatus is to be disassembled, the outer barrel is first unscrewed at the threads 54 from the upper sub 46, and the outer sub is lowered with the wash pipe 44 being pulled down out of the packing seal 52. A spring 70 is removed from the annular space between the inner and outer barrels. Then a downhole tool shown at 72 in FIG. 4 is lowered around the wash pipe 44 and through the annular space 74 previously occupied by the spring. The tool includes projections 76 which engage corresponding recesses 80 at the top of the hanger nut. The tool 72 can be rotated as by the chains used to thread sections of the drill string. Once the hanger nut 60 is unthreaded from the upper portion 62 of the percussion sub, the percussion sub can drop out of the outer barrel for maintenance.

Thus, the invention provides a percussion drilling apparatus wherein hammering occurs only a small distance above the drill bit and at a large diameter portion of the apparatus, and the hammering surfaces are protected against the intrusion of cuttings between them. Also, the outer barrel at the bottom of the drill string can be formed with only a single threaded connection therealong. The inner barrel has an anvil surface lying below the splines thereon, and has a cylindrical surface extending below the anvil surface. The outer sub has a hammer surface which hits the anvil surface, and holds a cage with a seal assembly thereon which surrounds the cylindrical surface to seal thereagainst. A hanger nut threadably engaged with an upper portion of the inner barrel, lies at least one foot below the threaded upper end of the outer barrel. An annular downhole tool can fit in the annular space between a wash pipe and the outer barrel, to enable turning of the hanger nut from a location above the threads at the top of the outer barrel.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a percussion drill apparatus which includes a drill string having an outer barrel near its lower end extending along an axis, and a lower inner barrel lying partially within the outer barrel and coupled to the outer barrel by spline means which allows the outer barrel to move along said axis relative to the inner barrel while causing them to rotate together about said axis, the inner barrel having means for holding a drill bit at its lower end, the inner barrel forming an upwardly facing anvil surface and the outer barrel forming a downwardly facing hammer surface which pounds on the anvil surface when the drill string drops, the improvement wherein:

said anvil surface lies below said spline means on said inner barrel, and said inner barrel has a cylindrical outer surface extending downwardly from said anvil surface; and said outer barrel includes a cage lying below said hammer surface and around said cylindrical outer surface of said inner barrel, and a lower seal lying below said hammer surface and within said cage and slideably sealingly mounted against said cylindrical outer surface of said inner barrel.

2. The improvement described in claim 1 wherein: said spline means includes splines on said inner and outer barrels and a quantity of oil at said spline means, said outer barrel being substantially devoid of a seal between the bottom of the spline means and said lower seal, whereby to enable double use of said lower seal to keep in oil and keep out cuttings.

3. The improvement described in claim 1 wherein:

said drill string includes an upper sub above said outer barrel, and said outer barrel having an upper end and a threaded portion which is threadably engaged with said upper sub;

said inner barrel includes a threaded upper portion and a wash pipe of smaller outside diameter than said threaded portion extending upwardly from said threaded portion, said outer barrel being of larger inner diameter than the outside of said wash pipe to leave an annular space between them;

said outer barrel having an upwardly facing shoulder at about the same height as said threaded portion of said inner barrel;

an annular hanger nut threadably engaged with said threaded portion of said inner barrel, said nut being of an outside diameter great enough so it can rest on said shoulder, to limit downward movement of the lower inner barrel; and the top of said nut lying below said upper end of said outer barrel;

a downhole tool with a bottom, said tool being of annular cross section to fit into said annular space, said hanger nut and the bottom of said tool constructed to engage to enable the tool to turn said nut.

4. The improvement described in claim 1 wherein:

said drill string includes an upper sub with a central fluid-carrying passage extending along said axis;

said outer barrel has an upwardly facing shoulder;

said inner barrel includes a threaded upper portion above said shoulder of said outer barrel, and a hanger nut threadably engaged with said upper portion and positioned to rest on said shoulder when said inner barrel moves down;

said inner barrel includes a wash pipe extending from above said threaded inner barrel upper portion along the inside of said outer barrel into said fluid-carrying passage, a wash pipe seal lying between the walls of said upper sub passage and said wash pipe, and a packing nut threadably engaged with said passage in said upper sub and holding said wash pipe seal in place;

spring means lying between said hanger nut and upper sub for biasing them apart;

said upper sub has a bottom thread for connection to said outer barrel, at about the same height as said packing nut, and said outer barrel extends continuously and devoid of threadably connected sections from said upper sub to said cage, said packing nut having means at its upper end which can be grasped to turn it.

5. A combination of a percussion drill string apparatus and tool comprising:

an upper sub having a substantially vertical axis and forming a conduit along said axis, said upper sub including a packing in said conduit and a packing nut under said packing;

an outer barrel threadably connected to said upper sub and having a hollow inside forming a shoulder;

an inner barrel that has a lower tool-holding portion for holding a cutting tool and that lies partially within said outer barrel said inner barrel being slideable along said vertical axis therewithin, said inner barrel having a threaded portion and having a wash pipe extending up from said threaded portion into said conduit and sealed to said packing;

a hanger nut threadably engaged with said threaded portion of said inner barrel and large enough to rest on said shoulder of said inner barrel;

the top of said hanger nut lying more than one foot below the level of said packing when said hanger nut rests on said shoulder;

said outer barrel and upper sub being threadably joined at about the level of said packing nut, so when the outer barrel and upper sub are disconnected, there is ready access to the packing nut but not to said hanger nut;

a tool of small enough diameter to pass into the top of said outer sub, and which is formed to engage said hanger nut and turn it.

6. The combination described in claim 5 wherein:

said tool has a hole which receives said wash pipe.

7. In a percussion drill apparatus which includes a drill string having an outer barrel near its lower end extending along a substantially vertical axis, and a lower inner barrel lying partially within the outer barrel and coupled to the outer barrel by spline means which allows the outer barrel to move along said vertical axis relative to the inner barrel while causing them to rotate together about said axis, the inner barrel having means for holding a drill bit at its lower end, the inner barrel forming an upwardly facing anvil surface and the outer barrel forming a downwardly facing hammer surface which pounds on the anvil surface when the outer barrel drops, the improvement wherein:

said anvil surface lies substantially no higher than said spline means on said inner barrel, and said inner barrel has a lower outer surface extending downwardly from said anvil surface;

said outer barrel includes a cage extending downwardly from said hammer surface and surrounding said lower outer surface of said inner barrel; and a lower seal means lying below said hammer and anvil surfaces and sealing said cage to said lower outer surface of said inner barrel said case being slidable relative to said inner barrel, whereby said seal protects the hammer and anvil surfaces from cuttings.

* * * * *